US008894433B2

(12) United States Patent
Little et al.

(10) Patent No.: US 8,894,433 B2
(45) Date of Patent: Nov. 25, 2014

(54) ELECTRICAL CONNECTOR ASSEMBLY WITH ENHANCED BLIND MATING FEATURES

(75) Inventors: Terrance F. Little, Fullerton, CA (US); An-Jen Yang, Irvine, CA (US); Kuo-Chun Hsu, New Taipei (TW); Duong Phan, Westminister, CA (US); I-Ting Chiang, Fremont (TW); Ming-Chuan Wu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 366 days.

(21) Appl. No.: 13/479,288

(22) Filed: May 24, 2012

(65) Prior Publication Data

US 2013/0316566 A1 Nov. 28, 2013

(51) Int. Cl.

*H01R 13/642* (2006.01)
*H01R 12/70* (2011.01)
*H01R 12/50* (2011.01)

(52) U.S. Cl.

CPC ..... *H01R 12/7005* (2013.01); *H01R 23/7005* (2013.01)
USPC ..... 439/378; 439/74; 439/607.13

(58) Field of Classification Search

CPC ..... H01R 12/7005; H01R 23/7005; H01R 12/7023; H01R 12/7029; H01R 23/7021; H01R 12/79; H01R 23/7026
USPC ..... 439/74, 378, 607.05, 607.13, 607.17
See application file for complete search history.

(56) References Cited

U.S. PATENT DOCUMENTS

| | | | | |
|---|---|---|---|---|
| 5,634,810 | A * | 6/1997 | Niitsu et al. | 439/378 |
| 8,292,635 | B2 * | 10/2012 | Little et al. | 439/74 |
| 2005/0282437 | A1 * | 12/2005 | Fan | 439/608 |
| 2006/0014422 | A1 * | 1/2006 | Fan | 439/567 |
| 2006/0014423 | A1 * | 1/2006 | Fan | 439/567 |
| 2006/0276060 | A1 * | 12/2006 | Takano | 439/74 |
| 2011/0053399 | A1 * | 3/2011 | Fahllund et al. | 439/325 |
| 2013/0090001 | A1 * | 4/2013 | Kagotani | 439/378 |
| 2013/0149908 | A1 * | 6/2013 | Little et al. | 439/660 |
| 2013/0176696 | A1 * | 7/2013 | Sun | 361/760 |
| 2013/0183850 | A1 * | 7/2013 | Kogotani | 439/378 |
| 2013/0316566 | A1 * | 11/2013 | Little et al. | 439/378 |
| 2013/0337681 | A1 * | 12/2013 | Little et al. | 439/569 |

FOREIGN PATENT DOCUMENTS

TW 531073 5/2003

* cited by examiner

*Primary Examiner* — James Harvey
(74) *Attorney, Agent, or Firm* — Wei Te Chung; Ming Chieh Chang

(57) ABSTRACT

An electrical connector assembly comprises a first connector unit and a second connector. The first connector unit comprises a first connector having an insulative housing with a plurality of contacts mounted thereon. A printed circuit board, on which the first connector is seated, defines a pair of mounting sections at opposite ends thereof and locate adjacent to the first connector. An insulative cover is attached to a first surface of the printed circuit board which is opposite to the first connector. The insulative cover forms a pair of guiding posts retained in said mounting sections and a pair of stand-off sections located at opposite ends thereof for supporting the first connector during the mating process. A metallic cover is attached to the insulative cover. The second connector defines a pair of guiding apertures at opposite ends thereof for receiving said guiding posts.

19 Claims, 11 Drawing Sheets

ELECTRICAL CONNECTOR ASSEMBLY WITH ENHANCED BLIND MATING FEATURES

BACKGROUND OF THE INVENTION

1. Field of the Invention

The present invention relates to an electrical connector assembly, and more particular to an electrical connector assembly with enhanced blind mating features.

2. Description of the Related Art

TaiWan Pat. No. 531073 issued on May 1, 2003 discloses an electrical connector assembly comprises a first connector and a second connector. The first connector includes an insulative housing having a mating tongue with a plurality of contacts disposed thereon. A pair of guiding posts are formed at opposite ends of the mating tongue. The second connector includes an insulative base defining a mating cavity therein. A plurality of contacts are retained in the insulative base with contacting portions disposed in the mating cavity. The insulative base also defines a pair of guiding apertures at opposite end walls for receiving guiding posts of the first connector. However, as the guiding posts need to be in alignment with guiding apertures during the mating process, it is not very easy for the first connector mating with the second connector. Hence, an electrical connector assembly which can solve the problem is needed.

SUMMARY OF THE INVENTION

Accordingly, an object of the present invention is to provide an electrical connector assembly with enhanced blind mating features.

In order to achieve the object set forth, an electrical connector assembly comprises a first connector unit and a second connector. The first connector unit comprises a first connector having an insulative housing with a plurality of contacts mounted thereon. A printed circuit board, on which the first connector is seated, defines a pair of mounting sections at opposite ends thereof and locate adjacent to the first connector. An insulative cover is attached to a first surface of the printed circuit board which is opposite to the first connector. The insulative cover forms a pair of guiding posts retained in said mounting sections and a pair of stand-off sections located at opposite ends thereof for supporting the first connector during the mating process. A metallic cover is attached to the insulative cover. The second connector defines a pair of guiding apertures at opposite ends thereof for receiving said guiding posts.

Other objects, advantages and novel features of the invention will become more apparent from the following detailed description of the present embodiment when taken in conjunction with the accompanying drawings.

DETAILED DESCRIPTION OF THE INVENTION

Figure 1:
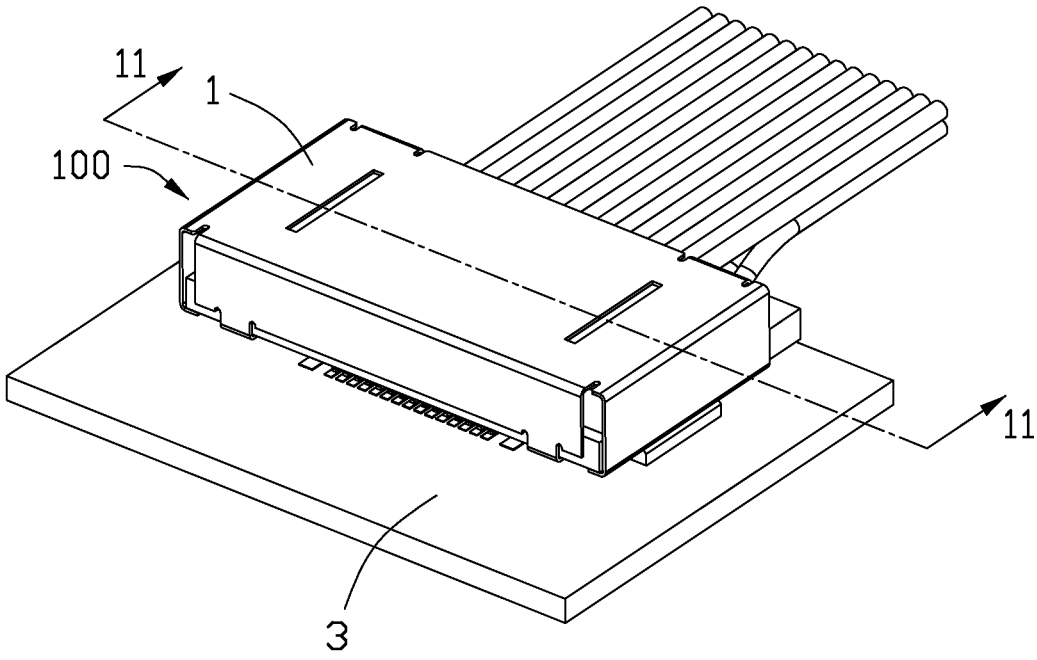
FIG. 1 is a perspective view of an electrical connector assembly in accordance with the present invention.
Figure 2:
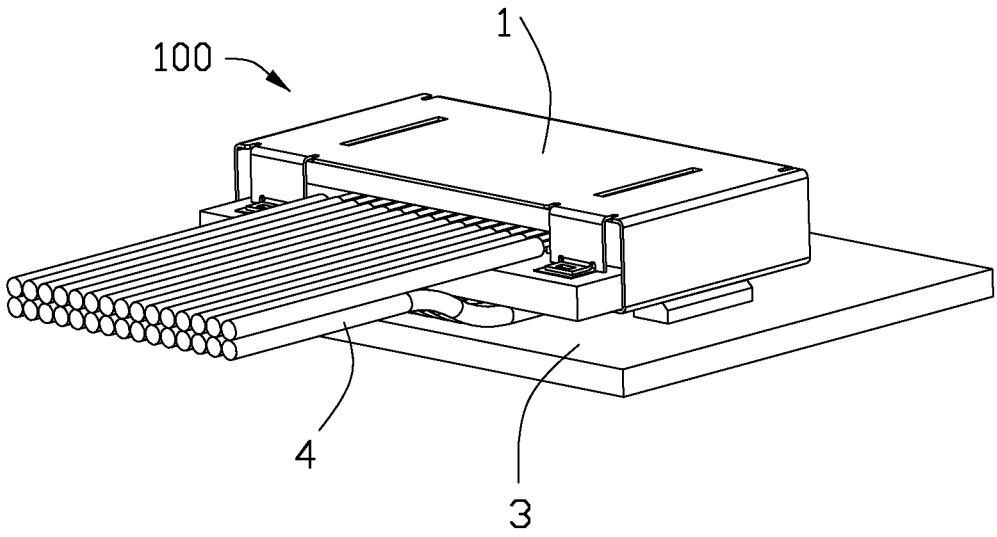
FIG. 2 is another perspective view of the electrical connector assembly shown in FIG. 1.
Figure 3:
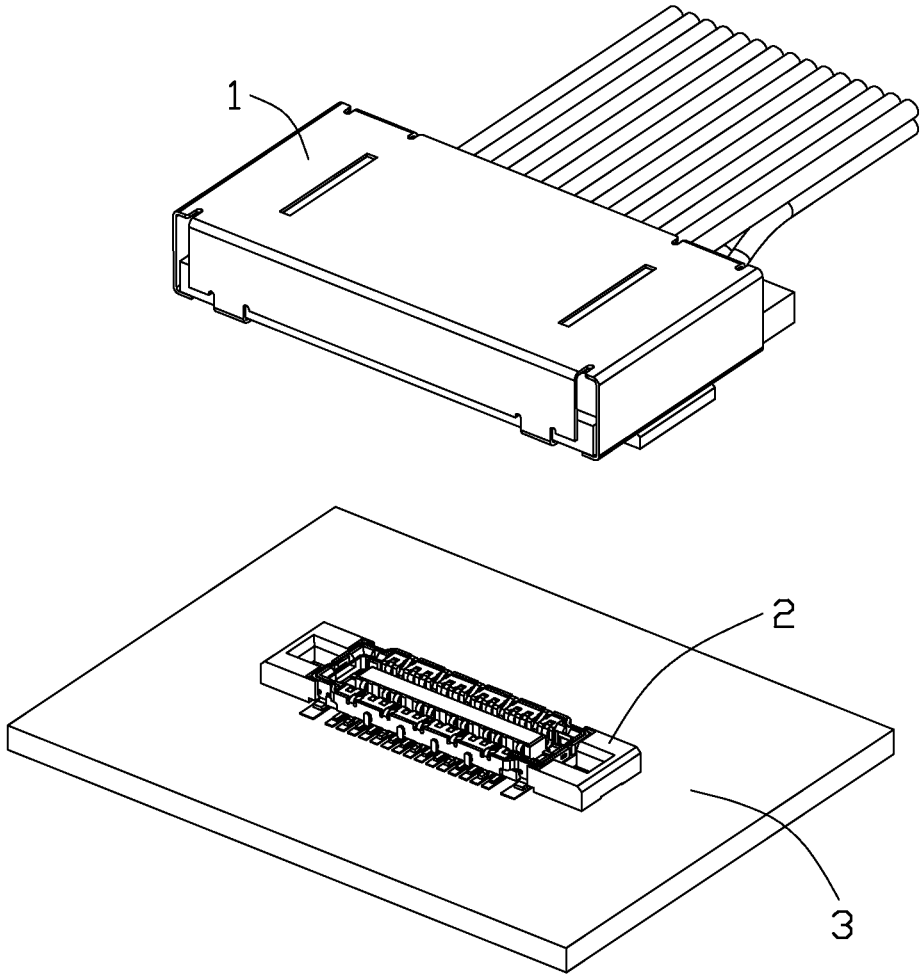
FIG. 3 is a perspective view of a first connector unit and a second connector shown in FIG. 1.

Reference will now be made to the drawing figures to describe a preferred embodiment of the present invention in detail. Referring to FIG. 1 to FIG. 3, an electrical connector assembly 100 in accordance with the present invention is provided and mounted on a board 3. The electrical connector assembly 100 comprises a first connector unit 1 and a second connector 2.

Figure 4:
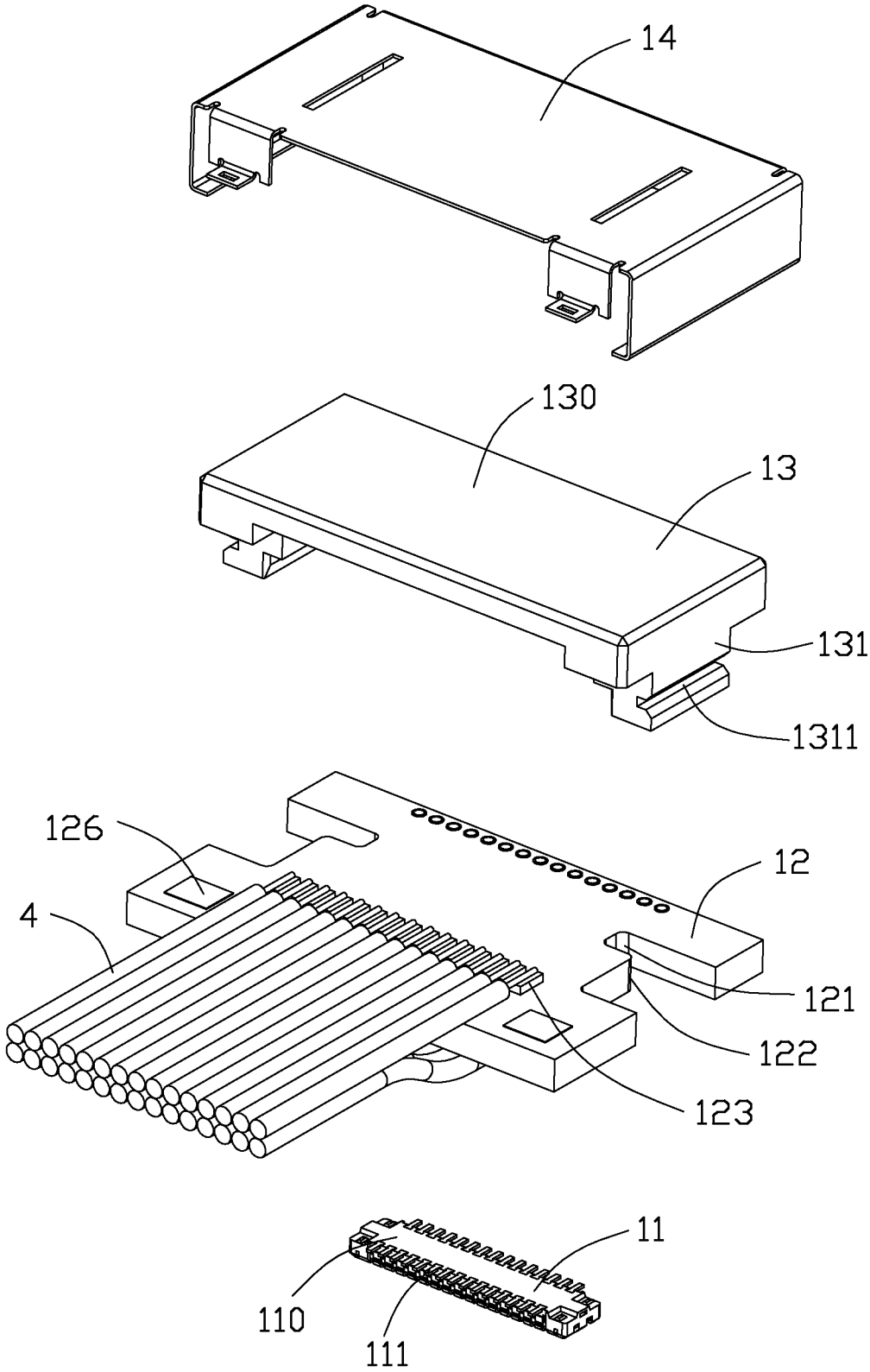
FIG. 4 is an exploded perspective view of the first connector unit shown in FIG. 3.
Figure 5:
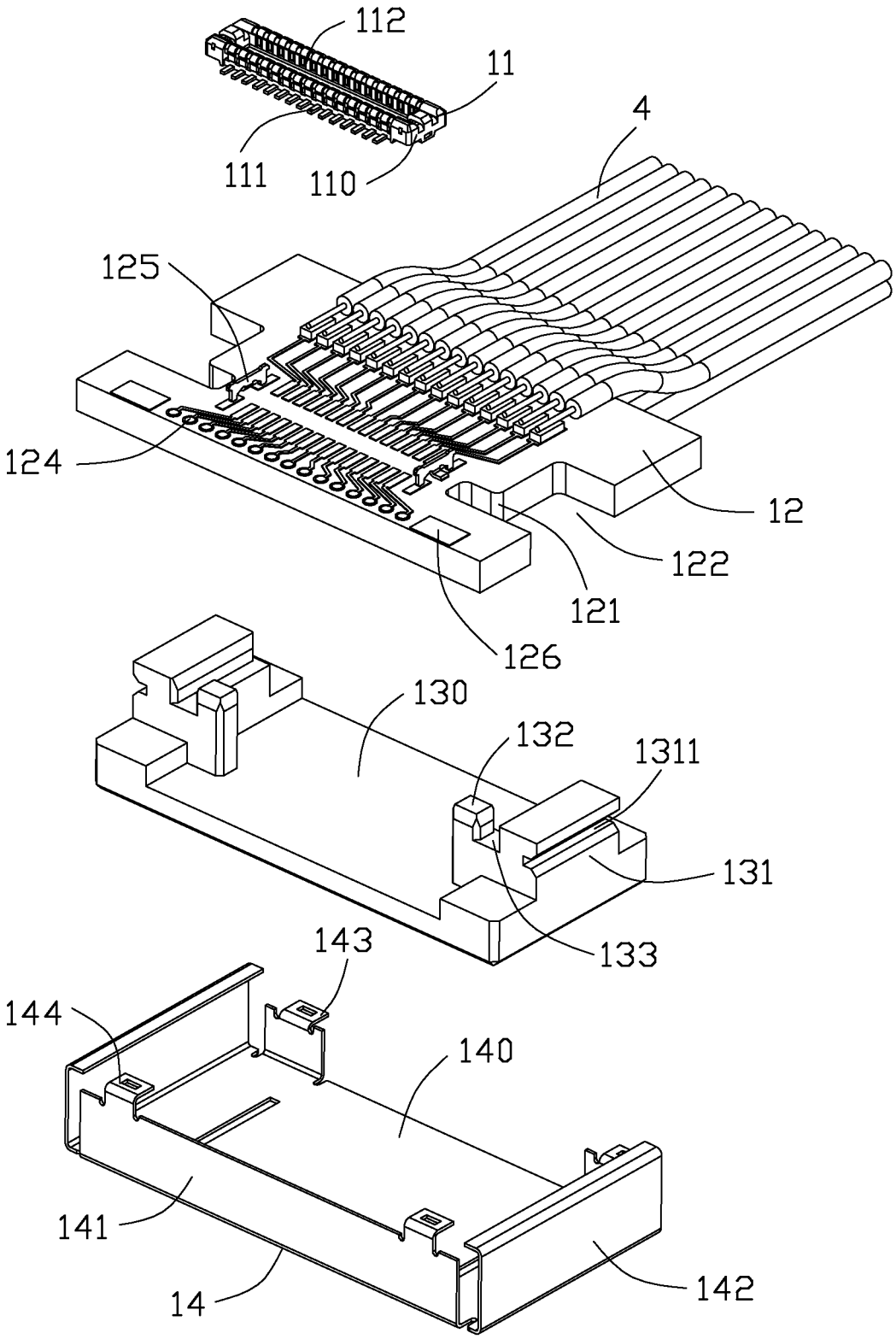
FIG. 5 is another exploded perspective view of the first connector unit shown in FIG. 3.
Figure 6:
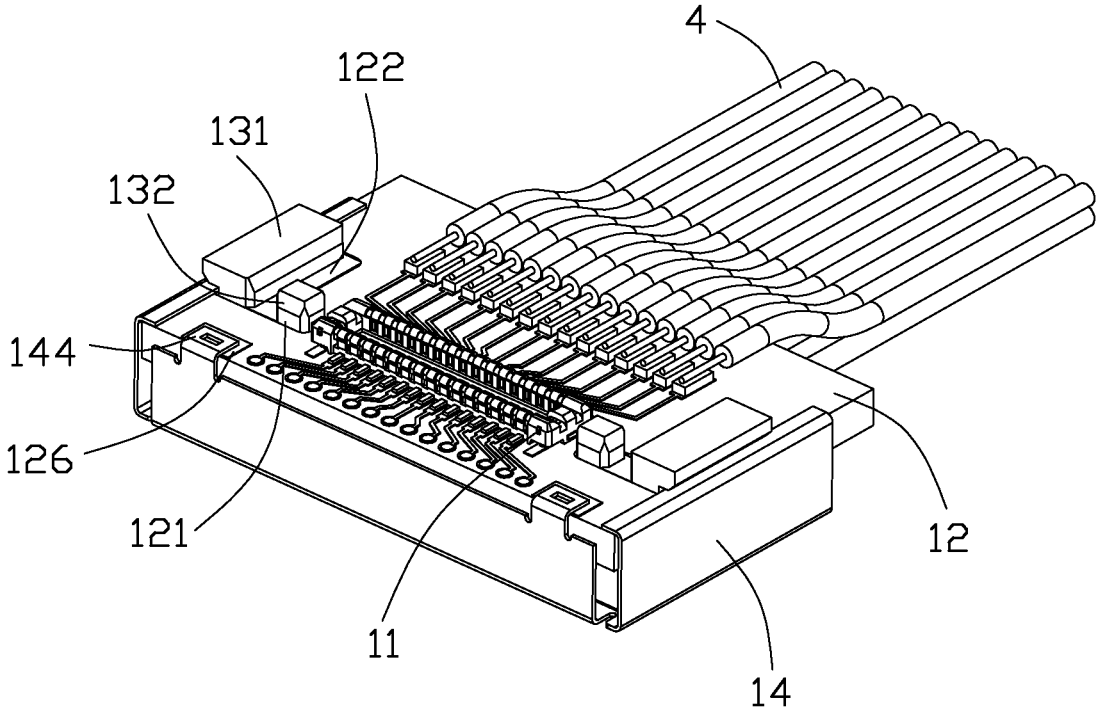
FIG. 6 is an assembled perspective view of the first connector unit shown in FIG. 3.

Referring to FIG. 4 to FIG. 6, the first connector unit 1 comprises a first connector 11, a printed circuit board 12, an insulative cover 13 and a metallic shell 14. The first connector 11 comprises an elongated housing 110 defines a mating cavity 112 therein. A plurality of contacts 111 retained in the elongated housing 110 with contacting portions disposed in the mating cavity 112.

The printed circuit board 12 is in a rectangular shape and forms a first surface on which the first connector 11 is seated and a second surface which is opposite to the first surface. A plurality of electric traces 124 are formed on the first surface to electrically connect with the contacts 111 of the first connector 11. A pair of metal ears 125 are formed on opposite ends of the first connector 11 and stand on the first surface of the printed circuit board 12. A pair of mounting sections are formed at lateral edges of the printed circuit board 12, each of which comprises a narrow opening 121 at an inner side and a wide opening 122 at an outer side. Each mounting section is configured as an h-shape and located adjacent to the first connector 11. Soldering pads 126 are respectively formed on the first and second surfaces of the printed circuit board 12, while located at different sides. Further, a plurality of solder elements 123 are formed on opposite surfaces of a same end of the printed circuit board 12 and contact with the electric traces 124. A plurality of cables 4 are soldered onto the solder elements 123 so as to electrically connect with the first connector 11.

The insulative cover 13 comprises a rectangular base 130 and a pair of stand-off sections 131 extending downwardly from opposite ends of the base 130. A pair of guiding posts 132 respectively extend downward from the base 130 and locate adjacent to the stand-off sections 131. An interval 133 is defined between the stand-off sections 131 and the guiding posts 132 for facilitating the first connector 11 to mate with the second connector 2. The insulative cover 13 is attached to a second surface of the printed circuit board 12 with the guiding posts 132 and stand-off sections 131 retained in the mounting sections of the printed circuit board 12. The guiding posts 132 are received in the narrow openings 121 and protrude beyond the first surface of the printed circuit board 12 so as to provide a guiding function during the mating process. The stand-off sections 131 are received in the wide openings 122 and protrude further than the guiding posts 132 so as to support the first connector 11 during the mating process.

The metallic shell 14 is made by stamping and bending a metal sheet, which comprises a body portion 140 attached to the base 130 of the insulative cover 13. A front wall 141 extends downward from a front edge of the body portion 140 and forms a pair of soldering parts 144 at a lateral edge. The soldering parts 144 are soldered on the soldering pads 126 on the first surface of the printed circuit board 12. A pair of soldering plates 143 extend downwardly from a rear edge of the body portion 140 and are soldered on the soldering pads 126 on the second surface of the printed circuit board 12. Further, a pair of locking portions 142 extend downward from opposite ends of the body portion 140 with distal ends retained in corresponding receiving slots 1311 defined on outer sides of the stand-off sections 131.

Figure 7:
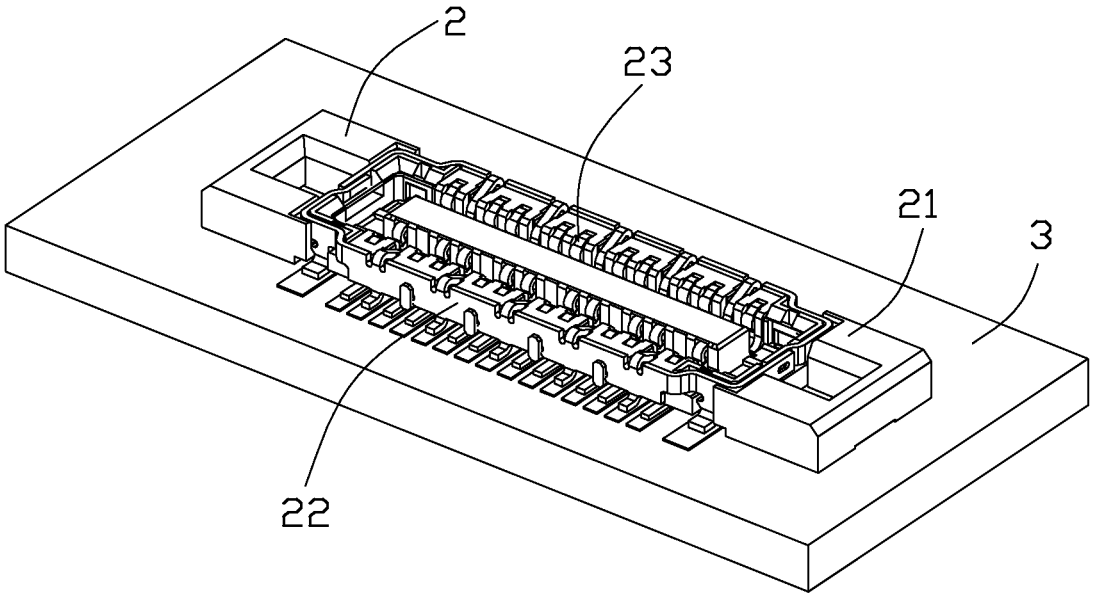
FIG. 7 is a perspective view of the second connector shown in FIG. 3 mounted on a printed circuit board.
Figure 8:
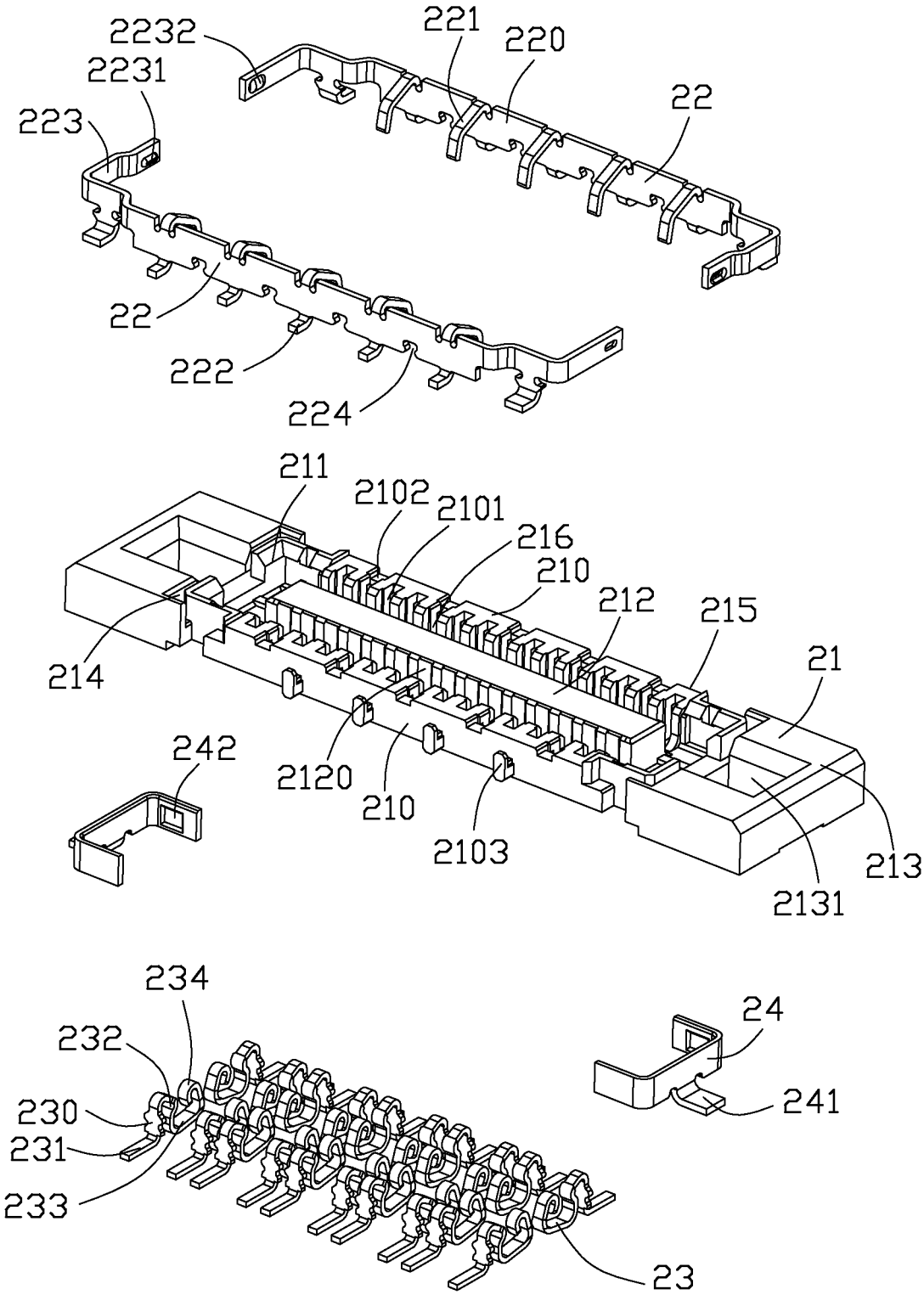
FIG. 8 is an exploded perspective view of the second connector shown in FIG. 7.
Figure 9:
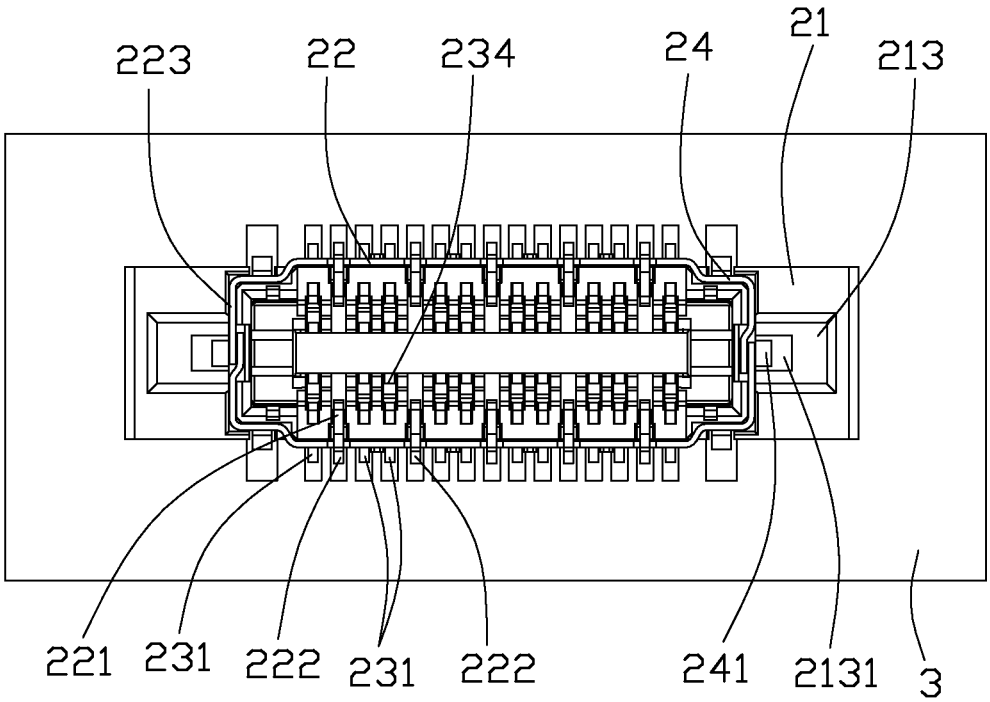
FIG. 9 is a vertical view of the second connector shown in FIG. 7.

Referring to FIG. 7 to FIG. 9, the second connector 2 comprises an insulative housing 21 with a plurality of contacts 23 retained therein, a pair of metallic shields 22 and a pair of metal tabs 24.

The insulative housing 21 comprises a body section 215 and a pair of guiding sections 213 at opposite ends thereof. A pair of assembling grooves 214 are defined between the body section 215 and the guiding sections 213 for receiving the metallic shields 22. The body section 215 has a pair of elongated side walls 210 and a pair of end walls 211 connecting with the side walls 210 thereby defining a mating cavity 216 therebetween. A plurality of first contact grooves 2101 are defined at inner sides of the side walls 210 and extend along an up-to-down direction. A plurality of gaps 2102 are defined on an upper side of the side walls 210 and communicate with the first contact grooves 2101. Each gap 2102 is formed between a pair of first contact grooves 2101 in this embodiment. A mating tongue 212 extends upwardly in the mating cavity 216 with a plurality of second contact grooves 2120 defined at opposite sides thereof. Each second contact groove 2120 faces to a corresponding first contact groove 2101. Further, a plurality of blocks 2103 are formed on outer sides of the side walls 210, and each block 2103 is configured as an L-shape. The guiding sections 213 define a pair of guiding apertures 2131 thereon for receiving the guiding posts 132 of the insulative cover 13.

Each contact 23 comprises a body portion 230, a solder portion 231 extending from one end of the body portion 230, a first contact portion 232 extending from the other end of the body portion 230, a connecting portion 233 and a second contact portion 234 extending from the first contact portion 232 and defining a U-shape configuration together with the first contact portion 232. The contacts 23 are assembled on the insulative housing 21 from a bottom side, with the first contact portions 232 received in the first contact grooves 2101 and second contact portions 234 received in the second contact grooves 2120. The contacts 23 are divided into several contact groups, each contact group comprises a pair of contacts 23 in this embodiment.

The metallic shields 22 are assembled on the insulative housing 21 along the up-to-down direction and received in the assembling grooves 214 so as to surround a periphery of the insulative housing 21. Each metallic shield 22 comprises an elongated body portion 220 and a pair of locking arms 223 bending inwardly from opposite ends of the body portion 220. The pair of metallic shields 22 are engaged with each other by cooperation of locking protrusions 2231 and openings 2232 formed on the locking arms 223. A plurality of grounding arms 221 and solder legs 222 extend reversely from an upper edge and a lower edge of the body portion 220 respectively. The grounding arms 221 project into the mating cavity 216 through the gaps 2102 and are received in the first contact grooves 2101. Each grounding arm 221 is located between neighboring contact groups, therefore the second contact groove 2120 which is opposite to the grounding arm 221 is empty. At a bottom side of the body portion 220, a plurality of locking openings 224 are defined for receiving the blocks 2103 on the side walls 210.

The metal tabs 24 are assembled in the mating cavity 216, and each comprises a solder tail 241 projecting into the guiding aperture 2131 for providing a retaining force when the second connector 2 is soldered onto the board 3. Further, the metal tab 24 comprises a locking portion 242 disposed in the mating cavity 216.

Figure 10:
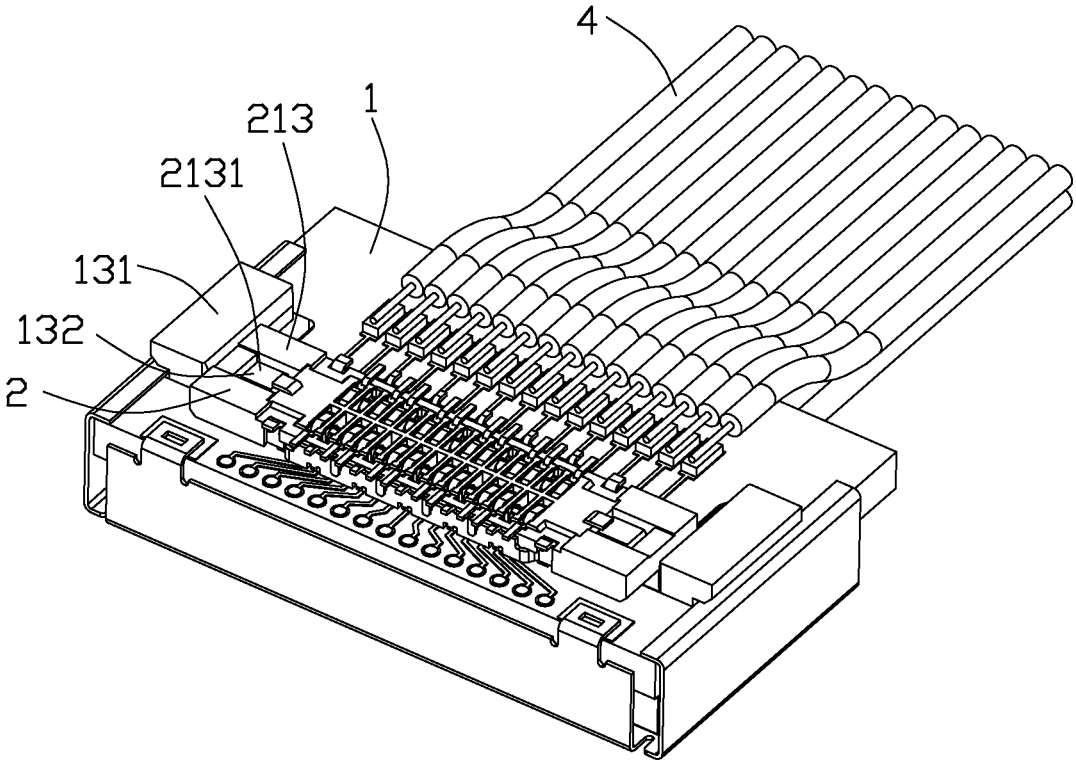
FIG. 10 is a perspective view of the first connector unit mated with the second connector shown in FIG. 3.
Figure 11:
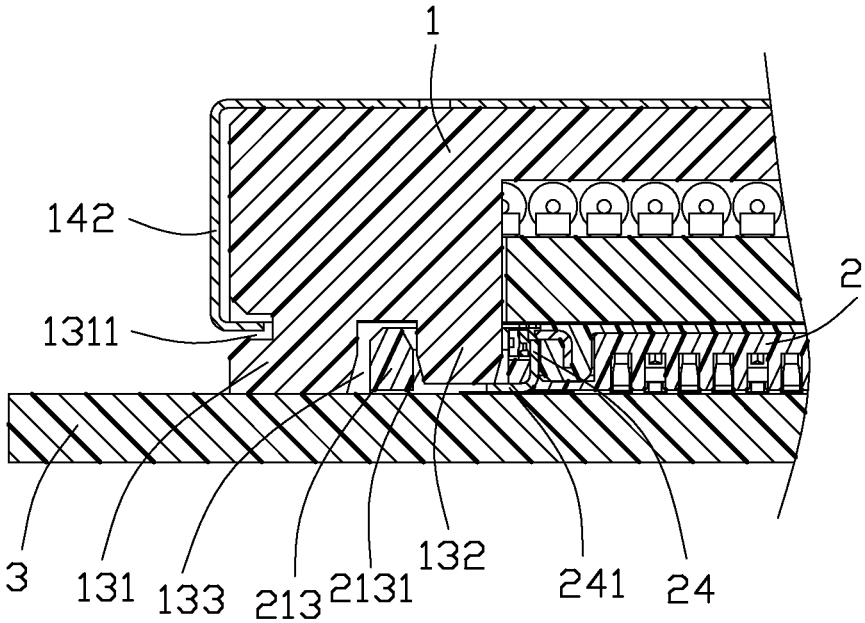
FIG. 11 is a cross-sectional view of the electrical connector assembly shown in FIG. 1 along line 11-11.

Referring to FIG. 10 to FIG. 11, when the first connector unit 1 is mated with the second connector 2, the first connector 11 electrically contacts with the second connector 2. The locking portion 242 of the metal tab 24 buckles with the metal ear 125 so as to enhance the latching features between the first connector 11 and the second connector 2. Further, if the second connector 2 is mounted on the board 3, the guiding posts 132 are received in the guiding apertures 2131 with the stand-off sections 131 located at lateral sides of the guiding section 213 of the second connector 2 and standing on the board 3 for supporting the second connector 2, which provide a blind mating feature for the electrical connector assembly 100. Under completely mating status, the second connector 2 is located in a space between the pair of stand-off sections 131.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a first connector unit, comprising a first connector, having an insulative housing with a plurality of contacts mounted thereon;

a printed circuit board, on which the first connector is seated, defining a pair of mounting sections at opposite ends thereof and located adjacent to the first connector;

an insulative cover, attached to a first surface of the printed circuit board which is opposite to the first connector, the insulative cover forming a pair of guiding posts retained in said mounting sections and a pair of stand-off sections located at opposite ends thereof for supporting the first connector during the mating process;

a metallic cover, attached to the insulative cover; and a second connector, defining a pair of guiding apertures at opposite ends thereof for receiving said guiding posts.

2. The electrical connector assembly as described in claim 1, wherein the second connector is located in a space defined between the pair of stand-off sections.

3. The electrical connector assembly as described in claim 1, wherein the guiding posts are located at inner sides of the stand-off sections and protrude beyond a second surface of the printed circuit board which is opposite to the first surface.

4. The electrical connector assembly as described in claim 3, wherein the metallic cover encloses the insulative cover with a pair of locking portions extending downwardly, each stand-off section defines a receiving slot at an outer side for receiving said locking portion.

5. The electrical connector assembly as described in claim 4, wherein the metallic cover and the insulative cover engage with the printed circuit board by a soldering manner with solder pad formed on the metallic cover respectively soldering on the first surface and second surface of the printed circuit board.

6. The electrical connector assembly as described in claim 3, wherein a plurality of cables are respectively connected to the first surface and second surface of the printed circuit board.

7. The electrical connector assembly as described in claim 3, wherein the mounting section is an h-shaped opening, with the guiding posts received in a narrow side while the stand-off sections received in a wide side.

8. The electrical connector assembly as described in claim 3, wherein the stand-off sections extend downwardly further than the guiding posts.

9. The electrical connector assembly as described in claim 1, wherein the second connector defines a mating cavity surrounded by at least one metallic shield, said guiding apertures are defined at opposite ends of the mating cavity.

10. A connector, comprising:

an insulative housing having a pair of elongated side walls and a pair of end walls connecting with said side walls thereby defining a mating cavity therebetween, a mating tongue extending upwardly in said mating cavity with a plurality of second contact grooves defined thereon, a plurality of first contact grooves defined on the side walls and correspondingly facing the opposite second contact grooves;

a plurality of contacts divided into several contact groups which comprising at least a pair of contacts, each contact having a first contact portion received in the first contact groove and a second contact portion received in the second contact groove;

at least one metallic shell surrounding a periphery of the insulative housing, the metallic shell comprising a body portion having a plurality of solder legs extending out of the insulative housing and a plurality of grounding arms projecting into the mating cavity and received in the first contact grooves between the first contact portions of neighboring contact groups;

wherein a pair of guiding portions are formed at opposite ends of the insulative housing with guiding apertures defined thereon.

11. The connector as described in claim 10, wherein a plurality of blocks are formed on an exterior face of the side walls, the metallic shell defines corresponding locking openings for receiving said blocks.

12. The connector as described in claim 11, wherein the metallic shell is assembled on the insulative housing along an up-to-down direction and each of said blocks is configured as an L-shape.

13. The connector as described in claim 10, wherein the solder legs and the grounding arms extend reversely from opposite edges of the body portion of the metallic shell.

14. An electrical connector assembly comprising:

a main printed circuit board;

a first connector mounted to the main printed circuit board;

a secondary printed circuit board position with regard to the main printed circuit board in a parallel relation;

a second connector mounted to the secondary printed circuit board and facing toward the main printed circuit board; and a shell associated with the secondary printed circuit board and forming a guiding mechanism for blind mating with the first connector; wherein said shell is primarily located upon a surface of the secondary printed circuit board opposite to a surface on which the second connector is located.

15. The electrical connector assembly as claimed in claim 14, wherein said shell includes at least an insulative piece or a metallic piece.

16. The electrical connector assembly as claim 14, wherein said shell defines a pair of posts for guidable receipt in a pair of guiding recesses of the first connector.

17. The electrical connector assembly as claimed in claim 14, further including a plurality of wires electrically and mechanically connected to the secondary printed circuit board.

18. The electrical connector assembly as claimed in claim 14, wherein said shell defines a pair of posts for guidable receipt in a pair of guiding recesses of the first connector, and said pair of posts extend through the secondary printed circuit board.

19. The electrical connector assembly as claimed in claim 17, wherein said wires are located upon two opposite surfaces of the secondary printed circuit board.

* * * * *